US005279871A

United States Patent [19]

Segan et al.

[11] Patent Number: 5,279,871

[45] Date of Patent: Jan. 18, 1994

[54] ACTION ORNAMENT WITH CHRISTMAS TREE MOUNTING THEREFOR

[75] Inventors: Marc H. Segan, New York, N.Y.; Michael Newsome, Jersey City, N.J.

[73] Assignee: M. H. Segan and Company, Great Barrington, Mass.

[21] Appl. No.: 972,316

[22] Filed: Nov. 5, 1992

[51] Int. Cl.[5] ..... A63H 29/08; A01N 3/00; A41G 1/00

[52] U.S. Cl. ..... 428/18; 446/171; 428/19

[58] Field of Search ..... 428/9, 12, 18, 19, 20, 428/542.2; 446/171, 168, 172

[56] References Cited

U.S. PATENT DOCUMENTS

| | | | |
|---|---|---|---|
| 1,195,927 | 8/1916 | McCloy | 40/409 |
| 1,492,105 | 4/1924 | Reynolds et al. | 446/171 |
| 1,628,903 | 5/1927 | Northrop | 40/563 |
| 2,734,993 | 2/1956 | Fritz | 240/10 |
| 3,035,162 | 5/1962 | Emmich | 240/10 |
| 3,233,090 | 2/1966 | Wagner | 240/10.1 |
| 3,650,056 | 3/1972 | Walton | 40/106.25 |
| 3,820,265 | 6/1974 | Leonard | 40/106.3 |
| 3,926,435 | 12/1975 | Nacci | 273/86 |
| 4,091,561 | 5/1978 | Kimura | 46/43 |
| 4,145,731 | 3/1979 | Adamich | 362/123 |
| 4,609,363 | 9/1986 | Udagawa | 446/444 |
| 4,678,449 | 7/1987 | Udagawa | 446/136 |
| 4,708,685 | 11/1987 | Udagawa | 446/139 |
| 4,778,430 | 10/1988 | Goldfarb et al. | 446/167 |
| 4,923,721 | 5/1990 | Gillmore | 428/11 |
| 4,928,955 | 5/1990 | Chuan | 446/171 |
| 4,980,608 | 12/1990 | Morrison | 315/185 |
| 4,989,120 | 1/1991 | Davis et al. | 362/35 |

*Primary Examiner*—George F. Lesmes
*Assistant Examiner*—Kathryne Elaine Shelborne
*Attorney, Agent, or Firm*—Cohen, Pontani, Lieberman, Pavane

[57] ABSTRACT

The present invention is a Christmas display (10) resembling a ski-lift and ski-slope, for use in conjunction with a Christmas tree (92). The display (10) comprises a track (12) having a first end (14) and a second end (16), wherein the first end is at a higher elevation than the second end, and a lift (18) disposed between the first end (14) and the second end (16). The device also comprises a plurality of figurines (30) having a base configured for slidable movement along track (12) from the first end of track (12) to the second end of track (12) whereby the lift (18) transports the figurine (30) back to the first end (14) of the track (12) in a continuous manner. In the preferred embodiment, the display also comprises a support mechanism (90) for supporting the display on a Christmas tree.

12 Claims, 13 Drawing Sheets

ACTION ORNAMENT WITH CHRISTMAS TREE MOUNTING THEREFOR

BACKGROUND OF THE INVENTION

1. Field of the Invention

This invention pertains to decorative displays, and more specifically to decorative displays incorporating moving elements. Most particularly, the present invention pertains to decorative displays of the aforementioned type particularly suited for use as Christmas displays.

2. Background Art

A wide variety of ornamental displays incorporating moving elements exist. For example, U.S. Pat. No. 4,708,685 (Udagawa) discloses such a display comprising an inclined track having a first raised end and a second end therebeneath, with a lifting means disposed between the two ends. The lifting means transports a plurality of moving figurines from the second end of the track to the first end whereupon the figurines, which are mounted on rollers, traverse the track from the first end to the second end, and so on. A drawback to the Udagawa device is that it is capable of operation only when supported on a relatively flat surface, such as a ground surface or a table top. The devices disclosed in U.S. Pat. Nos. 4,678,449 and 4,609,363 suffer similar drawbacks.

It is, therefore, an object the present invention to provide a display which is capable of operation while suspended above a ground surface. In particular, it is an object of the present invention to provide a Christmas display, incorporating moving elements, for use in conjunction with a Christmas tree, thereby creating a visually pleasing effect.

Another object of the present invention is to provide a Christmas display, incorporating moving elements and a track upon which the moving elements traverse, for use in conjunction with a Christmas tree, comprising a mechanism for positioning the track about the tree and above a ground surface.

It is a further object of the present invention to provide a Christmas display of the aforementioned type which simulates a ski-lift and a ski-slope, and which incorporates lifting means for lifting a plurality of figurines from one end of the ski-slope to the other whereupon the figurines traverse the ski-slope, thereby creating an "action" scene.

It is still a further object of the invention to provide means for optionally supporting the display on a ground surface.

SUMMARY OF THE INVENTION

The present invention is a display for use in combination with a Christmas tree, extending vertically upward from a ground surface. Broadly speaking, the present invention comprises a track having first and second ends with the first end being at a higher elevation than the second end, at least one figurine having a bottom surface portion configured for slidable movement along the track between the first and second ends, means for lifting the figurine from the second end of the track to the first end thereof for providing continuous traversal of the figurine along the track, and means for securing the track about the Christmas tree for supporting the track above the ground surface.

In the preferred embodiment, the display comprises attachable legs for supporting the track when the lift is optionally positioned on a flat surface.

The foregoing as well as additional details of the present invention will be more fully apparent from the following detailed description and annexed drawings of the presently preferred embodiments thereof.

DETAILED DESCRIPTION OF THE PREFERRED EMBODIMENT

Figure 1:
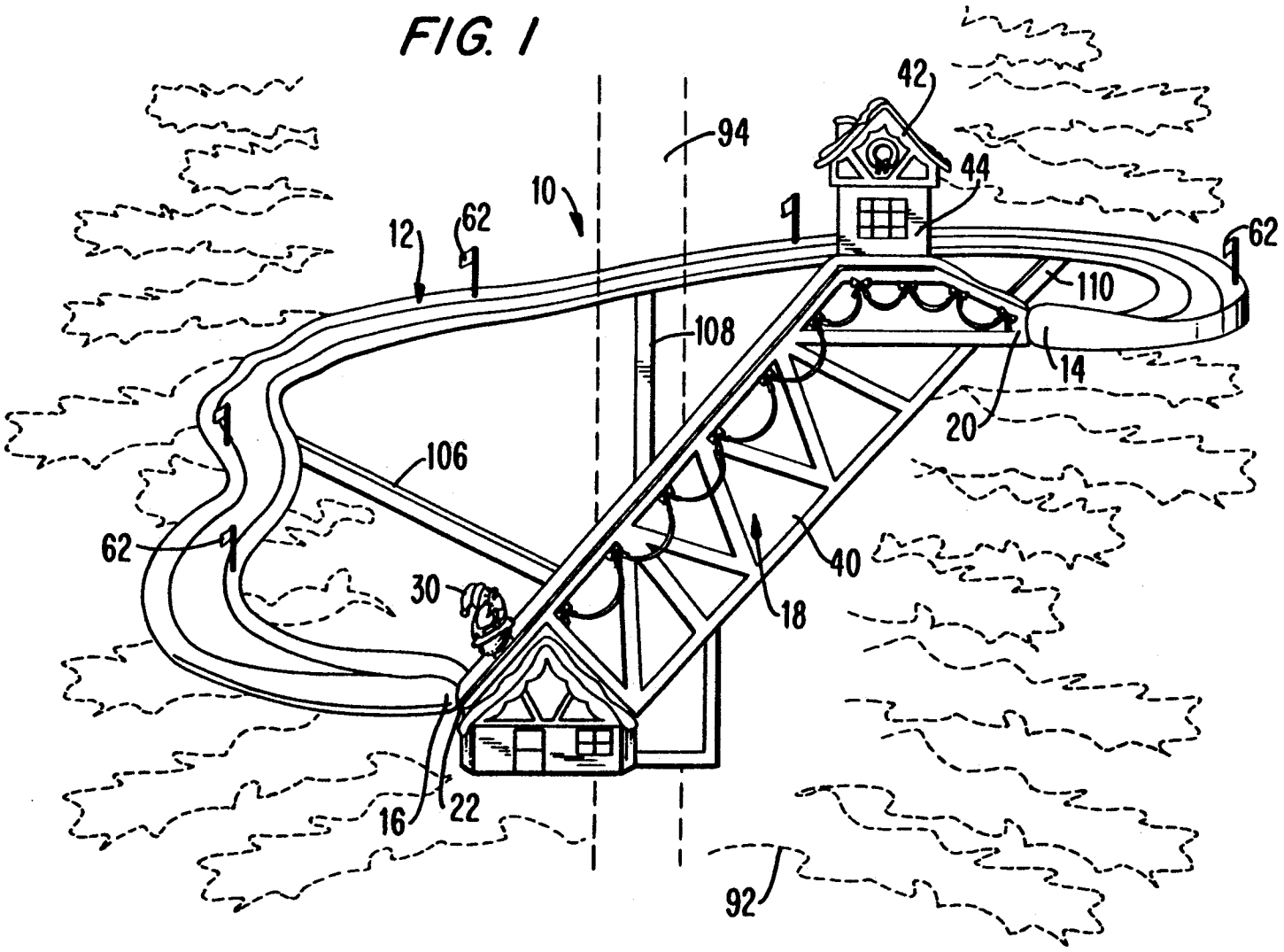
FIG. 1 is a perspective view showing the preferred display of the present invention supported on a Christmas tree.
Figure 2:
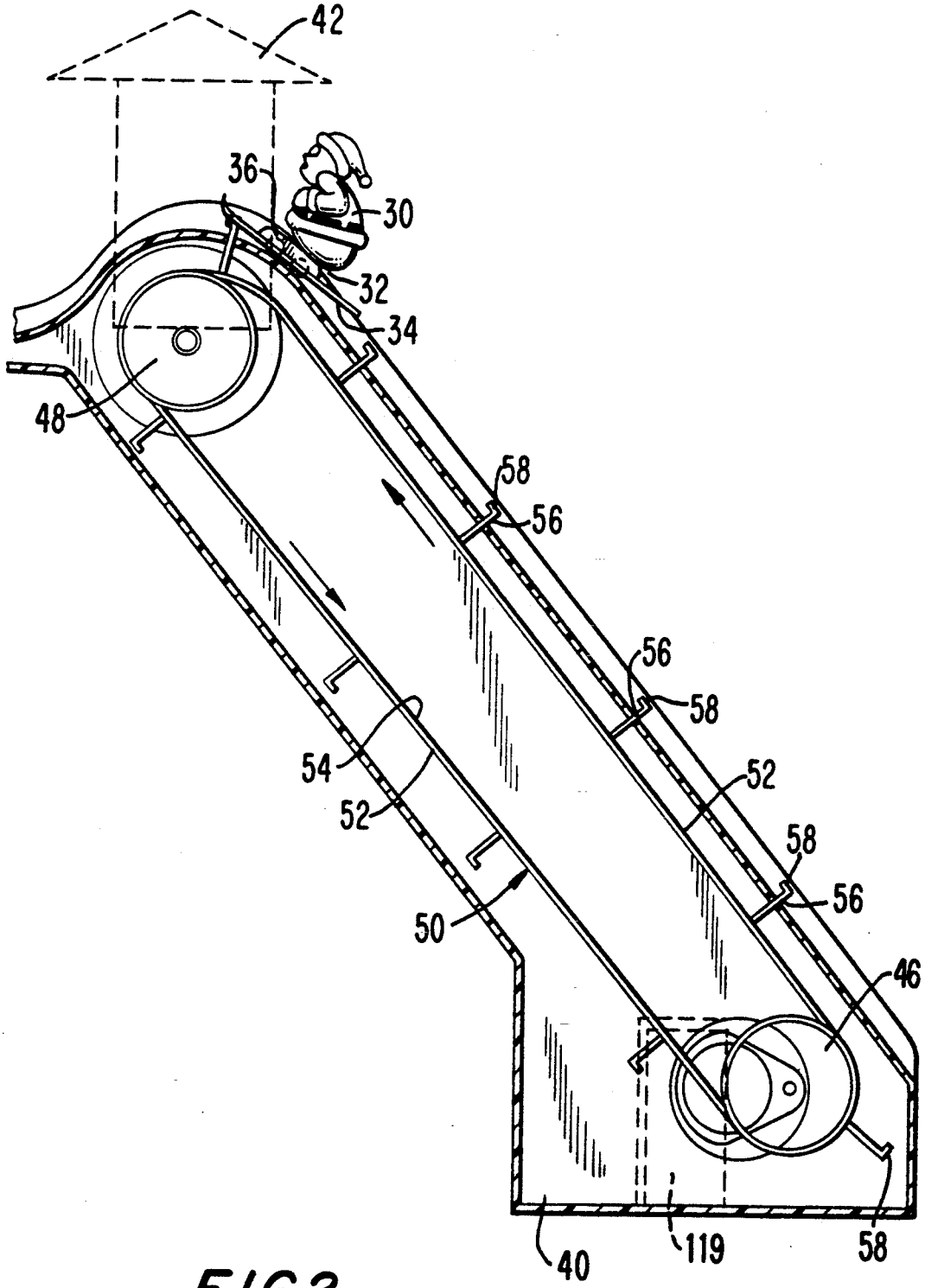
FIG. 2 is a cross-sectional view of the lift mechanism of the display of FIG. 1.
Figure 3:
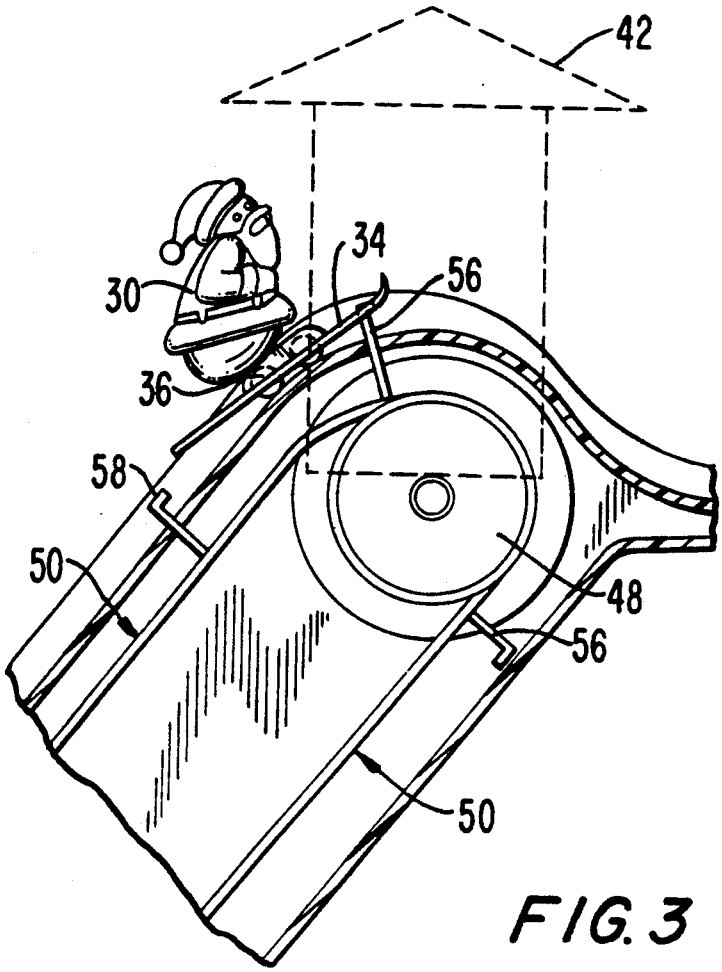
FIG. 3 is a cross-sectional view of the upper portion of the lift mechanism showing a figurine coupled thereto.

Referring now to the drawings and initially to FIG. 1, the display in accordance with the present invention is generally designated at 10. As shown, the display includes a curved track 12 having a first end 14 and a second end 16 with a lift 18, having a top 20 and bottom 22, disposed therebetween. The first end 14 of the track 12 is attached to the top 20 of the lift 18 and the second end 16 of the track is attached to the bottom 22 of the lift, such that the first end of the track is at a higher elevation than the second end. As shown, the track 12 has a continuous downward slope from its first end 14 to its second end 16.

Referring now to FIGS. 1–4, the display 10 includes at least one figurine 30 for traversing track 12. In the preferred embodiment, display 10 includes a plurality of Christmas theme figurines 30, such as a family on a sled or, as shown in FIG. 1, Santa Claus. As shown, figurine 30 has a base 32 comprising two substantially parallel spaced apart members 34 simulating skis, the front of the members 34 being connected by a cross-member 36. Two rollers 36 are mounted between the members 34 and aligned for facilitating traversal of track 12 by figurine 30.

Figure 4:
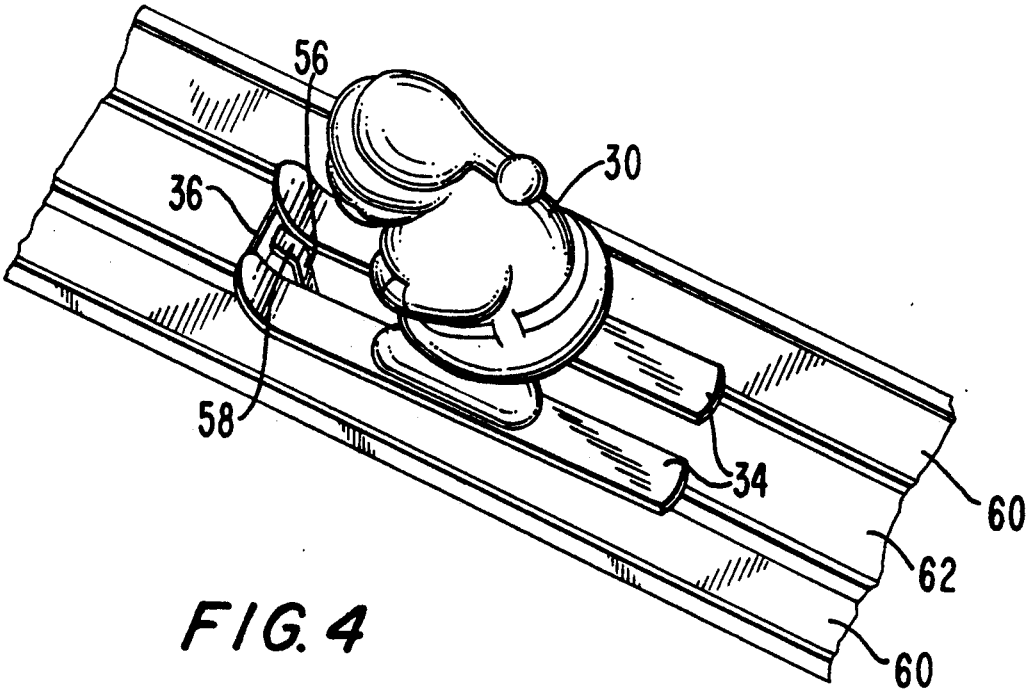
FIG. 4 is a fragmentary perspective view of the lift mechanism showing a figurine coupled thereto.

Lift 18 comprises a housing 40 supporting a decorative hut 42 having a base 44, and two spaced apart pulleys 46, 48, one positioned at the bottom 22 of lift 18 and the other positioned at the top 20. The hut 42 has two pegs (not shown) on its base 44 for snap-fitting into peg holes (not shown) on the top 20 of lift 18, thereby securing hut 42 to the top 20 of lift 18. The lift 18 also comprises an AC motor (not shown) for driving one of the pulleys 46, 48 in a manner well known to those of ordinary skill in the art. An endless belt 50 is positioned around pulleys 46, 48 for rotation thereabout when the motor is activated, also in a manner well known to those of ordinary skill in the art. The outer surface 52 of belt 50 has a plurality of spaced apart pins 56 oriented normal to the surface 52 and integrally formed therewith. Each pin 56 has a hooked end 58 for facilitating the seating of cross-member 36 and ensuring that the figurine 30 remains secured to endless belt 50 during lifting, as more fully explained below. Lift 18 also includes a receiving slot 1 19 and, as best shown in FIG. 4, an upper surface portion configured as a bifurcated ramp 60 having a slot 62. As more fully explained below, the ramp 60 overlies the endless belt 50 such that the hooked ends 58 of the pins 56 protrude through slot 62.

The AC motor is preferably powered by an external power cord (not shown) which connects lift 18 to a standard 120 v, 60 Hz electrical outlet. As is known to those of ordinary skill in the art, an on/off switch may be employed to supply or cut power to the motor or, in the alternative, the motor may be powered by batteries. When power is supplied, the A-C motor moves endless belt 50 in the direction shown by the arrows in FIG. 2 for transporting the figurine 30 from the bottom 22 of the lift 18 to the top 20 as one of the hooked ends 58 engages cross-member 36.

Figure 5:
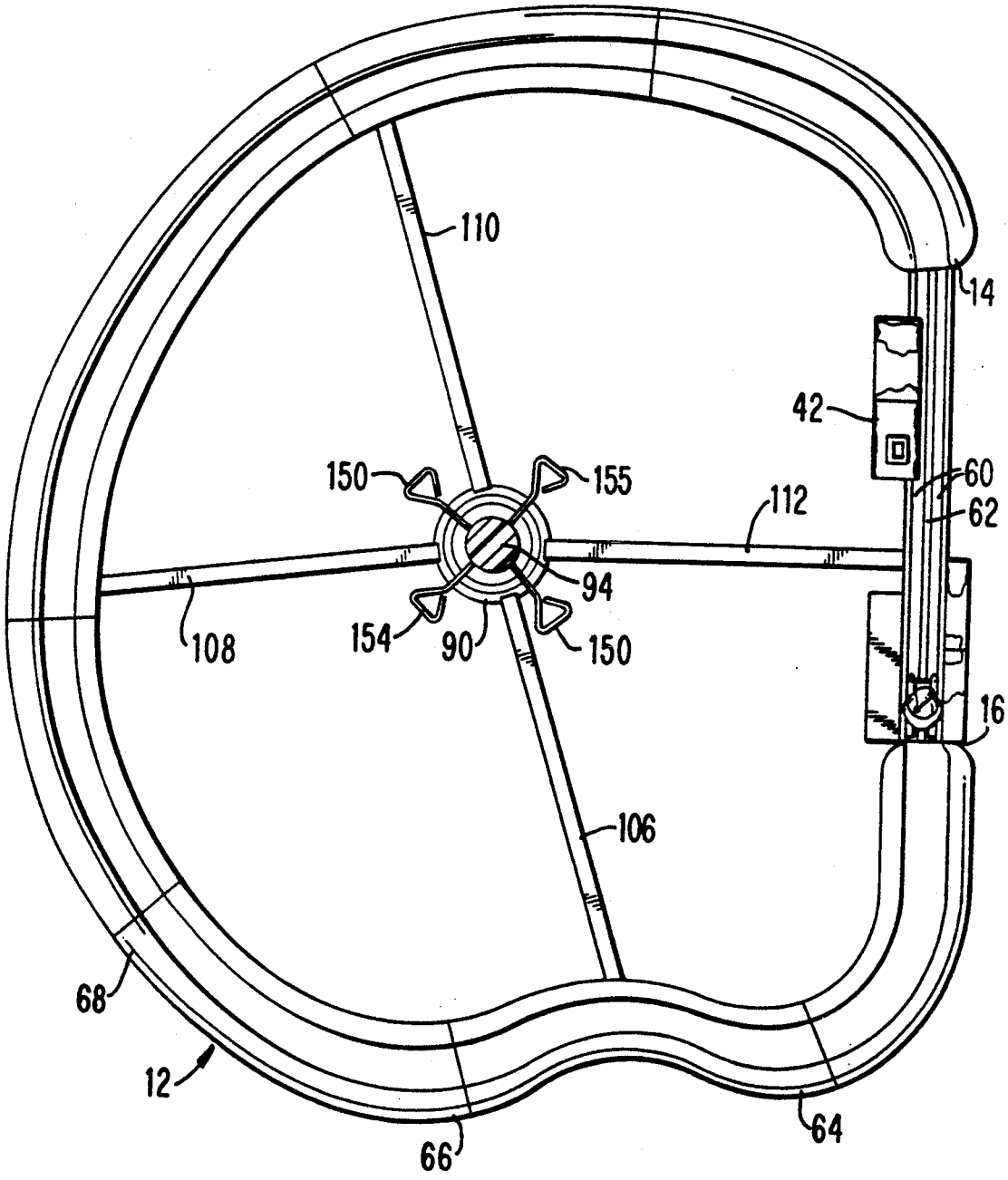
FIG. 5 is a top plan view of the preferred display shown in FIG. 1.
Figure 6A:
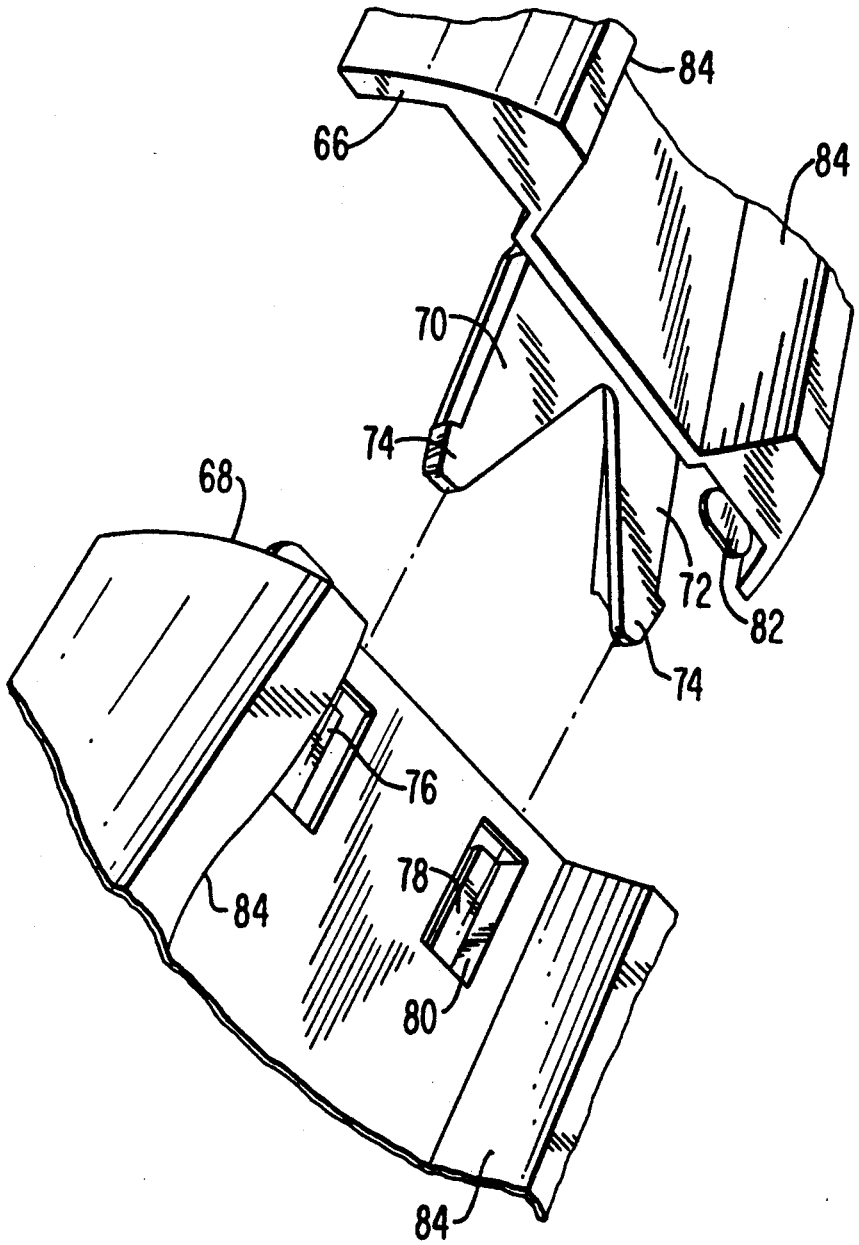
FIGS. 6A–C are fragmentary views of the means for coupling the track sections in the preferred display.
Figure 6B:
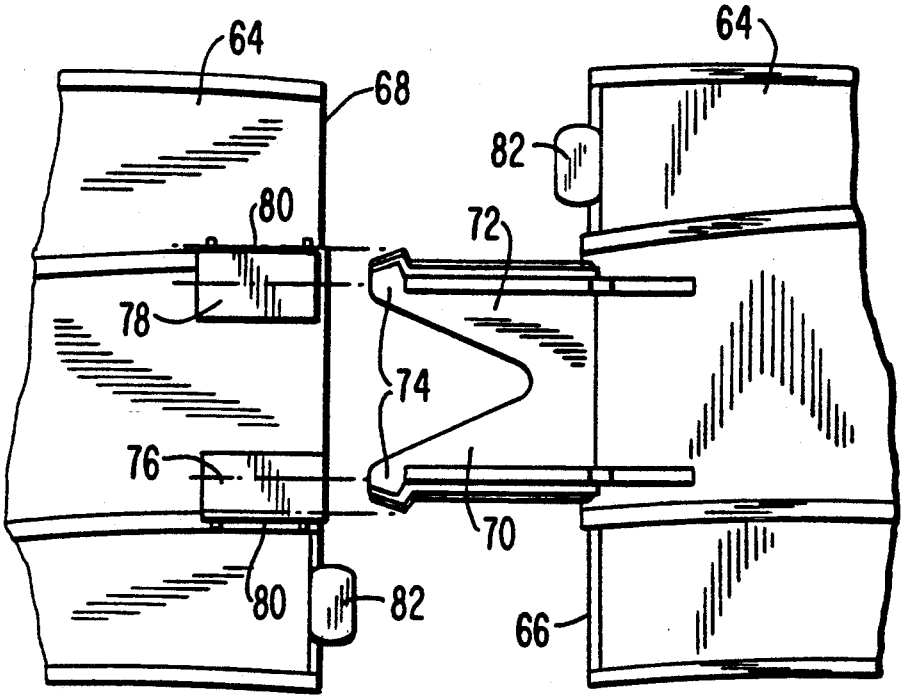
Figure 6C:
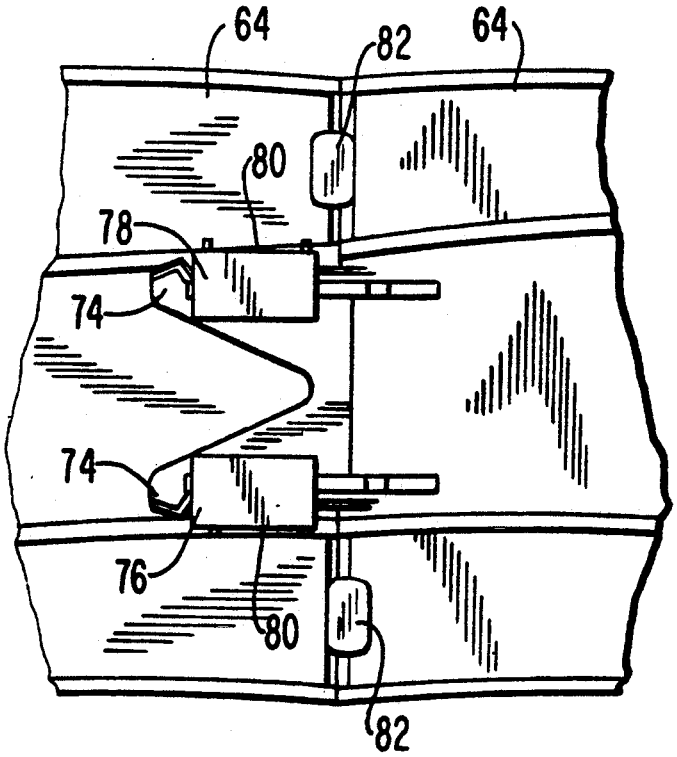
Figure 7:
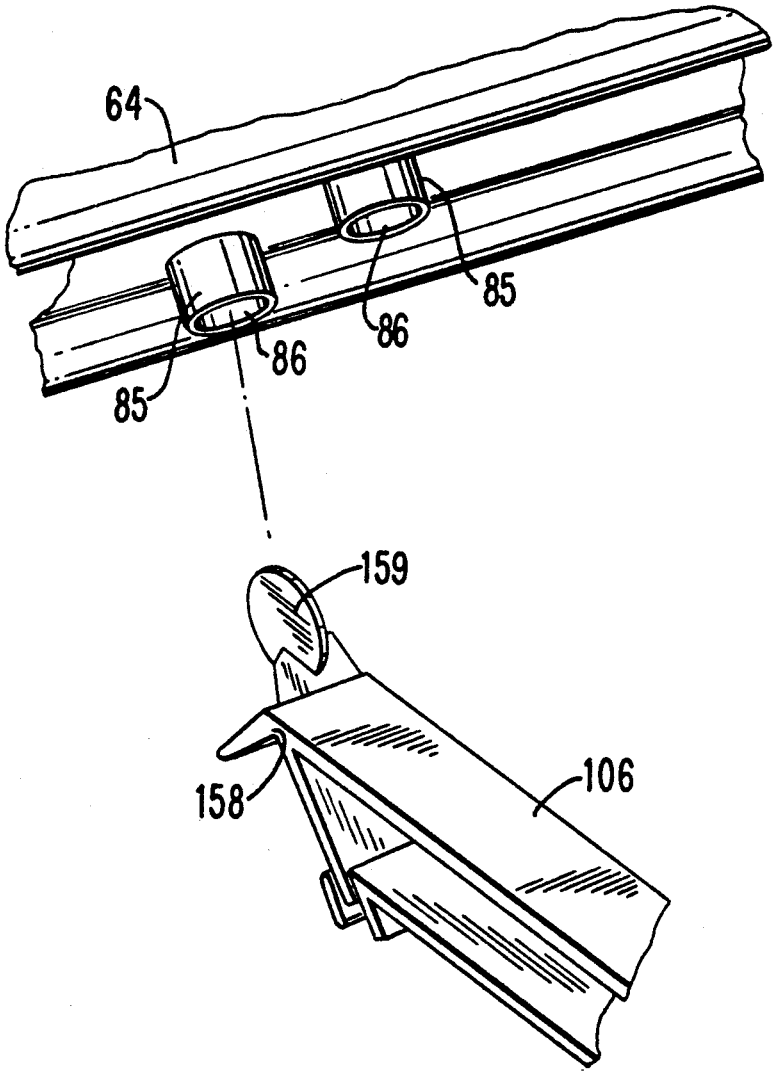
FIG. 7 is a fragmentary perspective view illustrating the connection between the support spokes and the track in the preferred display.

Referring now to FIGS. 5-7, track 12 comprises a plurality of interlocking straight and curved track sections 64, each having a first end 66, a second end 68 and parallel sidewalls 84, the latter serving to maintain the figurine 30 on the track 12 as it traverses same. The first end 66 of each section 64 has a generally "V"-shaped portion comprising a pair of protrusions 70, 72, each protrusion having a flared end 74. The second end 68 of each track section 64 has a pair of spaced apart channels 76, 78 spaced apart by a distance slightly less than the distance between the flared ends 74 of protrusions 70, 72. Each channel 76, 78 has an outer wall 80 having a length shorter than the length of the "V"-shaped portion. As should by now be apparent, track sections 64 are assembled to form track 12 by squeezing protrusions 70, 72 together and inserting them into channels 76, 78. As best shown in FIG. 6C, when this is done, the flared ends 74 slide along walls 80 until they reach the ends thereof, whereupon the flared ends spring apart and hook about the distal ends of the outer walls 80, thereby securing the track sections 64 together.

The configuration of the track 12 may be altered by adding or removing track sections 64, provided, of course, that track 12 begins at the top end 20 of lift 18 and terminates at the bottom end 22. In the preferred embodiment, and as shown in FIG. 6A, the first end 66 of each track section 64 has a tab 82 embossed with a designation for assisting the user in assembling the track 12 in a predetermined configuration. As shown in FIG. 7, the undersides of some track sections 64 include posts 85 having axial bores 86 for securing track 12 to support spokes 106, 108, 110 as more fully explained below. Preferably, the upper surfaces of at least some track sections 64 also included peg holes (not shown) for mounting stationary decorative ornaments such as flags 62, as shown in FIG. 1.

Figure 8:
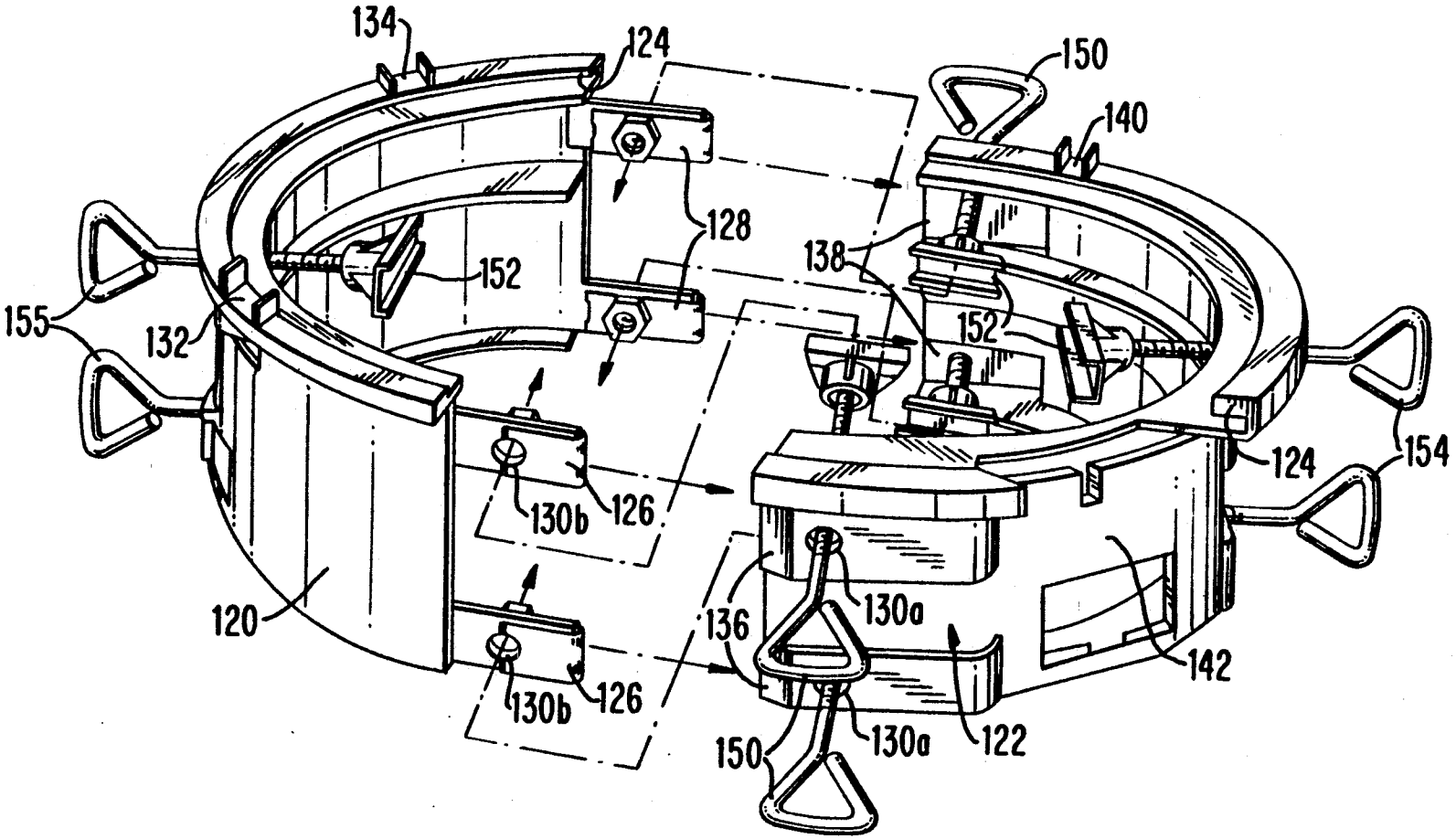
FIG. 8 is a perspective view of the collar for supporting the preferred display about the trunk of a Christmas tree.
Figure 9:
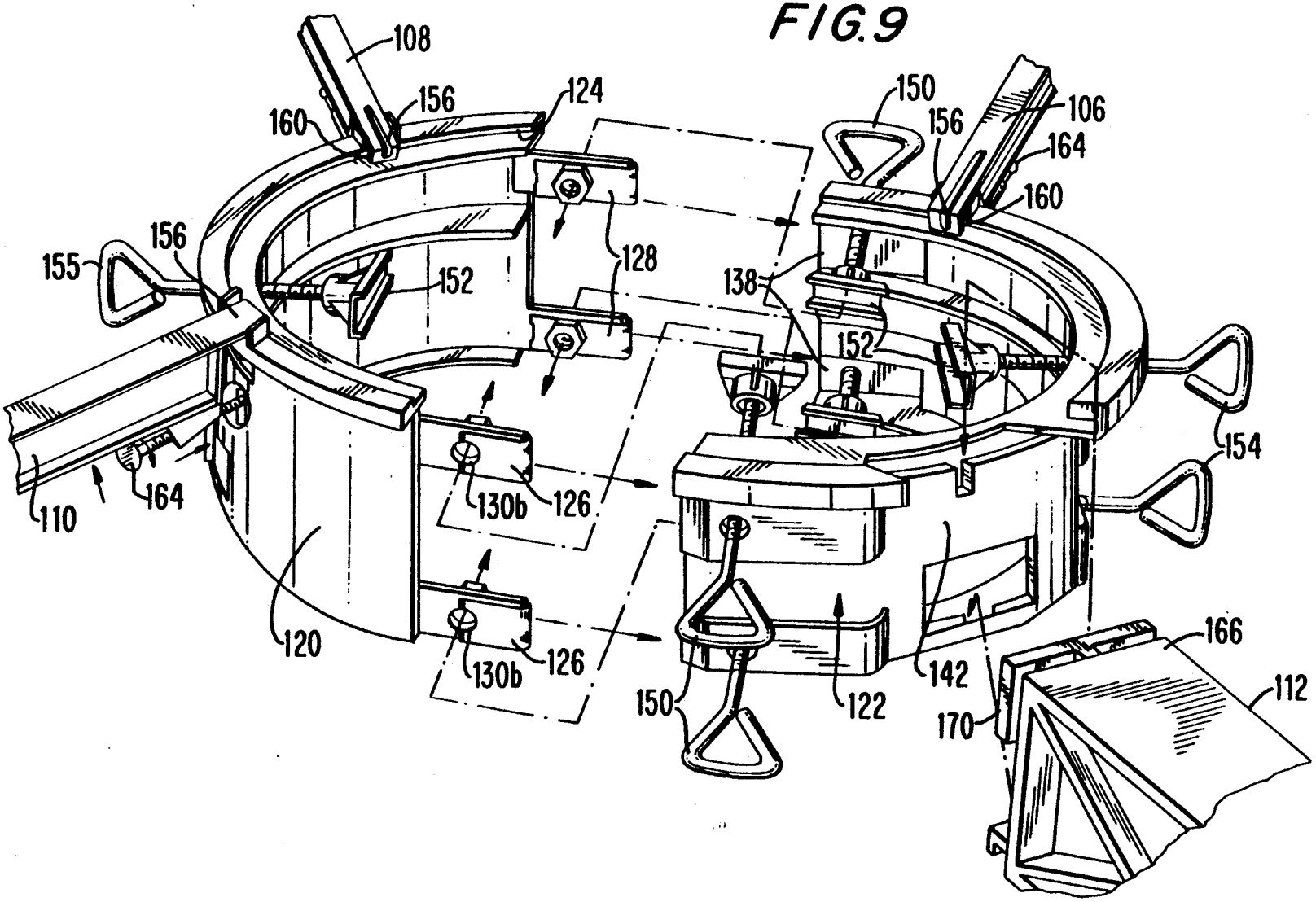
FIG. 9 is a partially exploded perspective view of the collar of FIG. 8 showing the manner in which the support spokes and support beam are coupled thereto.

Referring now to FIGS. 1-5, 8-9, the preferred display 10 includes a collar 90 for supporting the display above the ground about a vertical support member, such as the trunk 94 of a Christmas tree 92. As best seen in FIGS. 8 and 9, collar 90 comprises two "U-shaped" sections 120, 122 each having two free ends and an upper surface defining a lip 124. As shown, each free end of section 120 has a pair of alignment protrusions 126, 128, each protrusion having a threaded hole 130*b*. The upper surface of section 120 also has two upstanding U-shaped channels 132, 134 for receiving two of the three support spokes 106, 108, 1 10 as more fully explained below. Each free end of collar section 122 has a pair of securing channels 136, 138, confronting protrusions 126, 128, respectively, each channel having a threaded hole 130*a* for alignment with threaded holes 130*b* when collar 90 is assembled. Section 122 also includes an upstanding U-shaped channel 140 on the upper surface of lip 124 for receiving the remaining support spoke, and a support beam coupling 142 for accommodating attachment of support beam 112, all as more fully explained below.

Collar sections 120, 122 are assembled by first fitting the collar sections about the trunk 94 at a desired elevation and then pushing the two sections together until alignment protrusions 126, 128 seat in channels 136, 138 so that threaded holes 130*a*, 130*b* are aligned. Thereafter, collar 90 is secured to the trunk 94 by thumbscrews 150 which pass through aligned threaded holes 130*a* and 130*b* and seat against trunk 94, and by two additional pairs of thumbscrews 154, 155 which pass through screw holes (not shown) in collar sections 120, 122, respectively, these latter thumbscrews also seating against trunk 94. As shown, each thumbscrew has a grip 152 at its free end for firmly engaging the trunk, thereby firmly securing collar 90 in place.

Figure 10A:
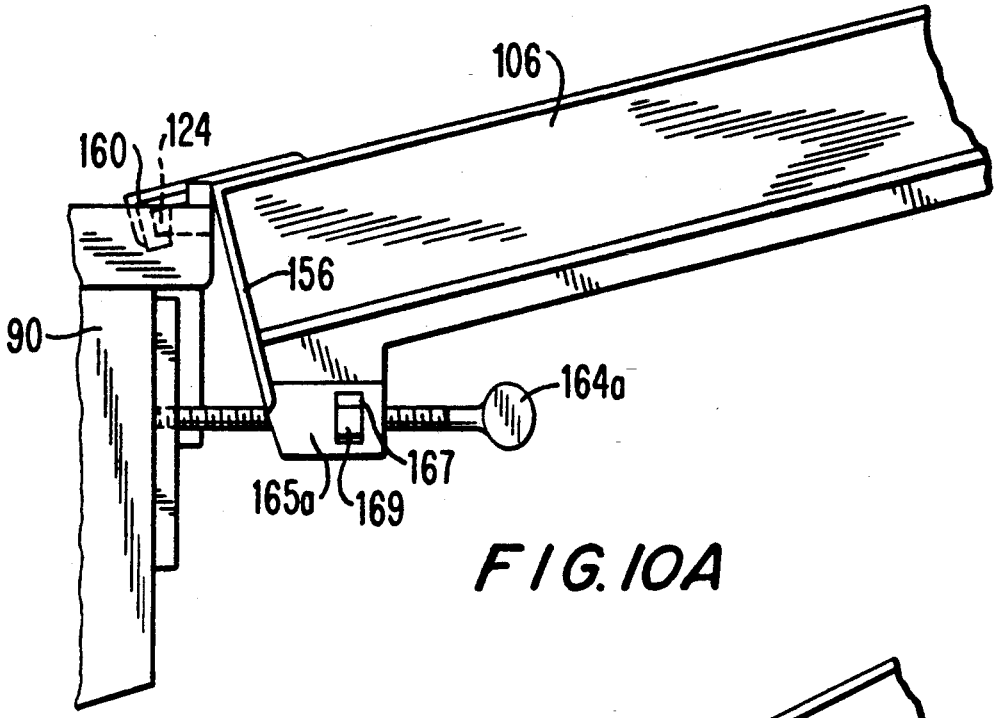
FIGS. 10A–B are fragmentary elevational views further illustrating the means for coupling the support spokes to the collar.
Figure 10B:
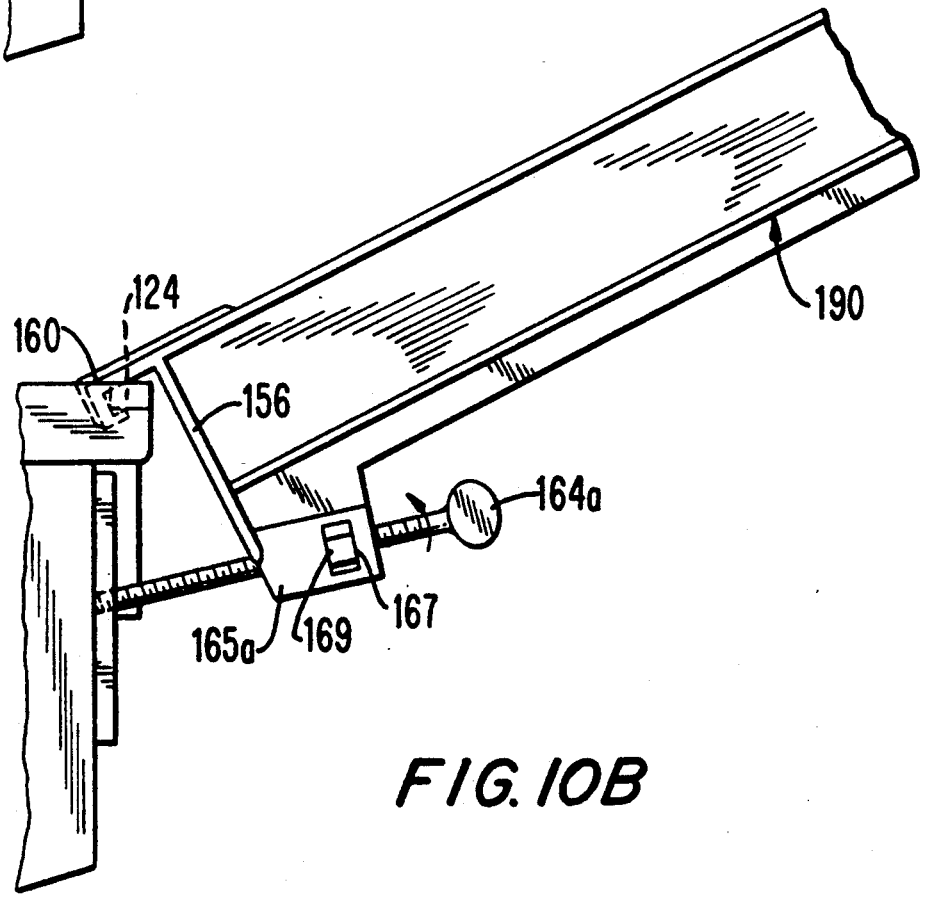

Referring now to FIGS. 7, 9, 10A and 10B, support spokes 106, 108, 110 extend radially outward from collar 90, each spoke having a coupling end 156 and a support end 158. Each coupling end 156 has a hooked portion 160 configured to hook onto lip 124 of collar 90. Each support end 158 has a flat protrusion 159 integrally formed therewith and configured for insertion into axial bores 86 located on the underside of track sections 64 for supporting the track 12 about the Christmas tree 92. To fine adjust the height of track sections 64, and as shown in FIGS. 10A and 10B, the coupling end 156 of each support spoke 106, 108, 110 is fitted with a thumbscrew 164 passing through a post 165 and seating against collar 90. As shown, each post 165 has a slot 167 supporting a threaded nut 169 for fixing the position of the respective thumbscrew 164. As the method of adjusting the portion of spokes 106, 108, 110 with thumbscrews 164 is the same, only adjustment of spoke 106 will be described.

Still referring to FIGS. 10A and 10B, when thumbscrew 164*a* in spoke 106 is turned clockwise, thereby screwing it further into post 165*a*, the distal end of the thumbscrew pushes against collar 90 whereupon the spoke 106 is urged upwardly as shown by the dotted lines and by arrow 190 in FIG. 10B. This, of course, serves to raise the track section 64 supported on spoke 106 relative to collar 90. As will now be understood, the track section supported on spoke 106 may be lowered by turning thumbscrew 164 in a counterclockwise direction.

Figure 11:
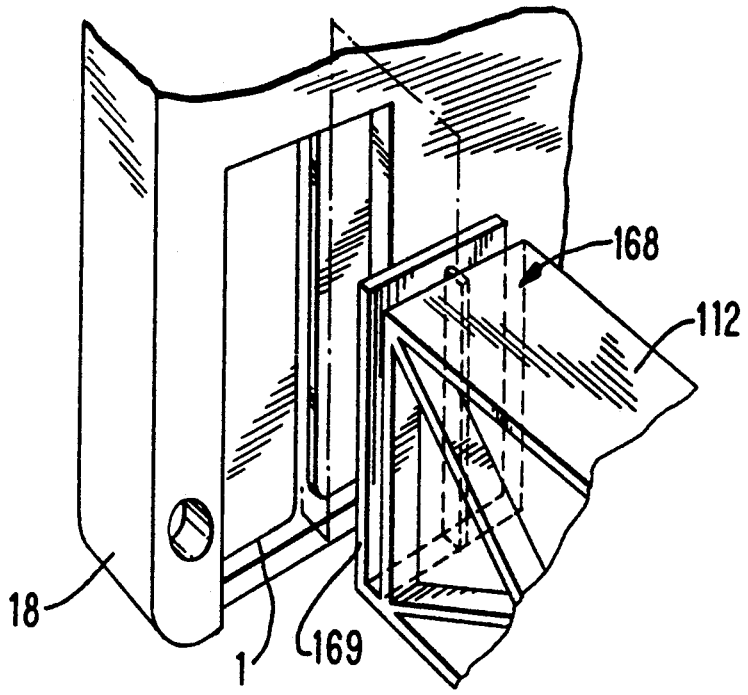
FIG. 11 is a fragmentary perspective view showing the connection between the support beam and the lift.

As lift 18 is substantially heavier than track 12, support beam 112 which secures lift 18 to collar 90 is sturdier than support spokes 106, 108, 110. As best shown in FIGS. 9 and 11 the support beam 1 12 has a first end 166 and a second end 168. The first end 166 has a "T"-shaped protrusion 170 configured for seating in the support beam coupling 142 on collar 90 and the second end 168 has a flange 169 configured for seating in a receiving slot 119 provided for the purpose on the inward facing surface of lift 18, thereby securing lift 18 to collar 90 in spaced relation from Christmas tree trunk 94. See FIG. 1.

Referring now to FIGS. 1–4, the operation of the display 10 will now be described. As shown, when figurine 30 is at the lower end 16 of the track 12 at the bottom of the lift 18, the cross-member 36 is positioned over the slot 62 in the bifurcated ramp 60. The figurine 30 remains stationary until the hooked end 58 of the next available pin 56 on endless belt 50 latches on to cross-member 36. As endless belt 50 rotates, it lifts figurine 30 to the top 20 of lift 18 which is at the upper end of track 12. When figurine 30 reaches the top of the lift, the momentum imparted by endless belt 50 causes figurine 30 to move forward thereby unseating cross-member 36 from pin 56 as the pin rounds the pulley 48, thereby disengaging figurine 30 from belt 50. Once disengaged, the continuous downgrade of track 12 causes the figurine 30 to traverse track 12 under the influence of gravity from the first end 14 to the second end 16 whereupon the cycle is repeated, such traversal being aided by the low friction of rollers 36. The result is a pleasing visual effect as figurine 30 repeatedly circles tree 92. In the preferred embodiment a plurality of figurines are included, thereby enhancing the visual effect.

In the preferred embodiment, track 12, lift housing 18, collar 90, support spokes 106, 108, 110 and support beam 112 are manufactured by injection molding utilizing any one of a variety of available thermoplastic resins, such as polystyrene.

Figure 12:
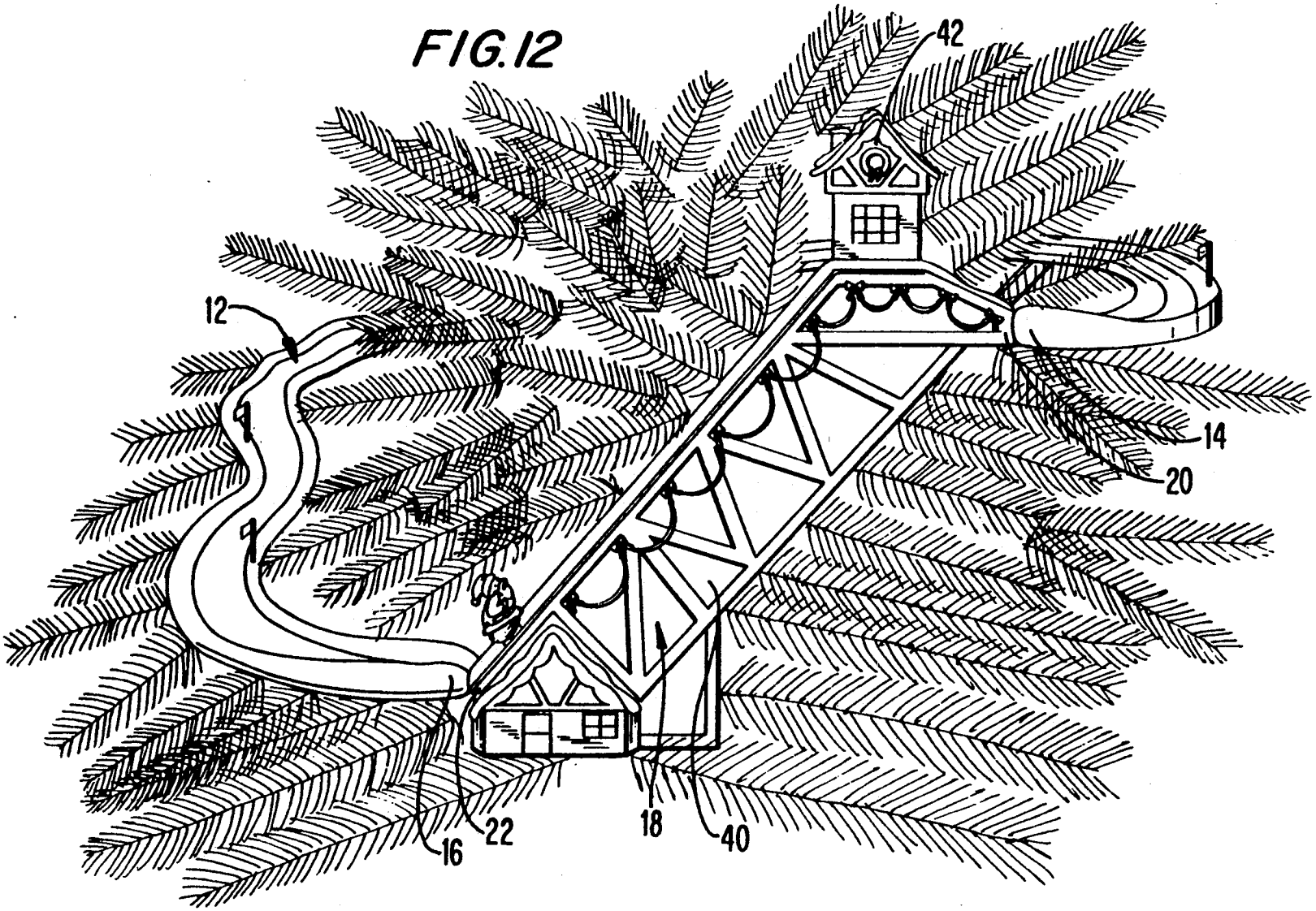
FIG. 12 is a perspective view of another embodiment of the present invention.

Referring now to FIG. 12, the branches of some Christmas trees, such as artificial Christmas trees, are substantially sturdier than natural trees. Accordingly, when the display 10 is used in conjunction with an artificial tree, it may be possible to support the track 12 and lift 18 directly on the tree's branches, i.e. without the use of collar 90, support spokes 106, 108, 110 and support beam 112.

Figure 13:
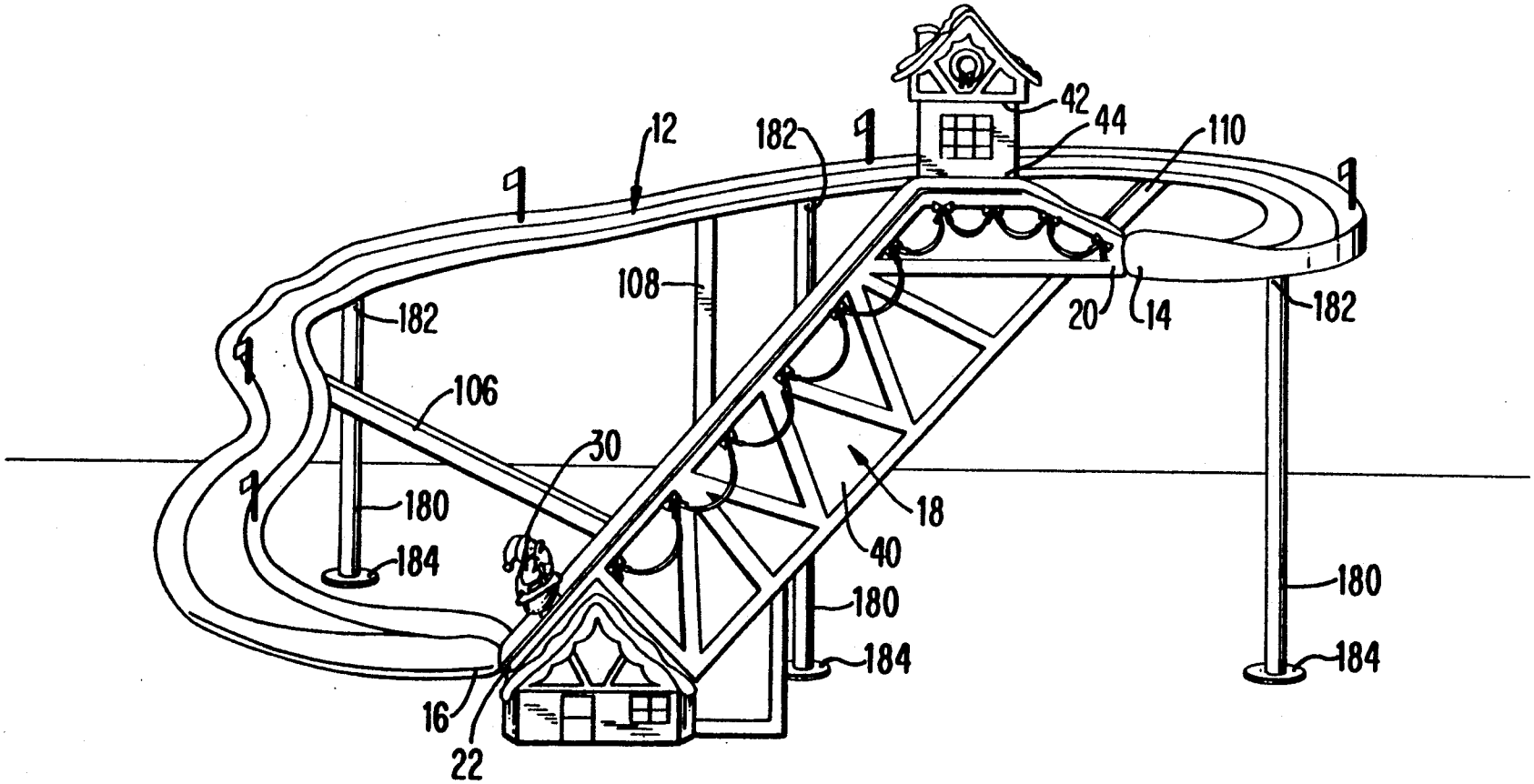
FIG. 13 is a perspective view of still another embodiment of the invention.

In the preferred embodiment of the invention, and as shown in FIG. 13, the display 10 includes three detachable legs 180 of varying lengths, each having a first end 182 and a second end 184. The first end 182 of each leg 180 is configured for insertion into axial bores 86 on the underside of selected track sections 64 and the second end 184 is configured as a foot for seating on a ground surface for supporting track 12 at an appropriate elevation. As shown in FIG. 13, in this embodiment the bottom of lift 18 also seats on the ground surface. As is now apparent, this feature provides the option of supporting display 10 on the ground, for example, about the base of Christmas tree 92.

Although I have herein shown and described the preferred embodiment of the invention, various changes and modifications will be readily apparent to those of ordinary skill in the art who have read the foregoing description. For example, substitute lifting means 18 may be utilized to transport the figurine from the second end of the track to the first end thereof. Rollers 36 may also be replaced with a low friction surface for easy translation of the track by figurines 30. Also, the device may be combined with a sound generating circuit for playing traditional Christmas melodies. As these as well as further changes and modifications are intended to be within the scope of the present invention, the foregoing description should be construed as illustrative and not in a limiting sense, the scope of the invention being defined by the following claims.

What is claimed is:

1. A display in combination with a member extending vertically upward from a ground surface, said display comprising:

a track having first and second ends, said first end being at a higher elevation than said second end;

at least one figurine having a bottom surface portion configured for slidable movement along said track between said first and second ends;

means for lifting said figurine from the second end of said track to the first end thereof for providing continuous traversal of said figurine along said track; and means for securing said track about said vertically extending Christmas tree for supporting said track above said ground surface.

2. The according to claim 1, wherein said means for securing said track about said vertically extending Christmas tree further comprises means for supporting said lifting means above said ground surface.

3. The of claim 2, wherein said securing means comprises a plurality of struts secured at one end to said securing means and at the other end to said track.

4. The of claim 3, wherein said securing means comprises a collar secured about said trunk and wherein said one end of said struts are secured to said collar.

5. The of claim 4, wherein said collar further comprises a plurality of coupling slots for securing said one end of said struts to said collar.

6. The of claim 5, wherein at least one of said plurality of struts being sturdier than the others for supporting said lifting means on said Christmas tree.

7. The of claim 4, wherein said collar is comprised of two interlocking sections.

8. The of claim 2, wherein said Christmas tree has a plurality of branches and said track has an undersurface, and wherein said securing means comprises said branches, said undersurface of said track being disposed thereon.

9. The of claim 2, further comprising a plurality of support legs detachably securable to said track and extending between said track and said ground surface for optionally supporting said track on said ground surface.

10. The of claim 2, wherein said lifting means comprises power supply means, a motor driven by said power supply means, an endless belt powered by said motor, and means for coupling said figurine to said endless belt when said figuring is at said second end of said track and for decoupling said figurine from said track when said figurine is at said first end of said track.

11. The of claim 10, wherein said figurine has a bottom surface portion comprising at least one roller for contacting said track as said figurine traverses same, a cross-member, and wherein said means for coupling and decoupling said figurine from said endless belt comprises a plurality of spaced members protruding from said belt for seating against said cross-member for lifting said figurine from said second end of said track to said first end thereof and for releasing from said cross-member as said endless belt approaches said first end of said track.

12. The of claim 2, wherein said track comprises a plurality of interlocking sections.

* * * * *

UNITED STATES PATENT AND TRADEMARK OFFICE

CERTIFICATE OF CORRECTION

PATENT NO. : 5,279,871

DATED : January 18, 1994

INVENTOR(S) : Marc H. Segan et al.

It is certified that error appears in the above-identified patent and that said Letters Patent is hereby corrected as shown below:

Column 6, Claim 1, line 1, delete "member" and add --Christmas tree--;

Column 6, line 28, after "The" insert --combination--;
line 32, after "The" insert --combination--;
line 35, after "The" insert --combination--;
line 38, after "The" insert --combination--;
line 41, after "The" insert --combination--;
line 44, after "The" insert --combination--;
line 46, after "The" insert --combination--;
line 51, after "The" insert --combination--;
line 56, after "The" insert --combination--;
line 63, after "The" insert --combination--;

Column 8, line 3, after "The" insert --combination--.

Signed and Sealed this

Ninth Day of August, 1994

*Attest:*

*Attesting Officer*

BRUCE LEHMAN

*Commissioner of Patents and Trademarks*